US005586342A

United States Patent [19]

Young

[11] Patent Number: 5,586,342

[45] Date of Patent: Dec. 24, 1996

[54] ROTARY SIPHON FLUSHER

[76] Inventor: Randy C. Young, 201 Bridgecreek Dr., Myrtle Beach, S.C. 29575

[21] Appl. No.: 471,857

[22] Filed: Jun. 6, 1995

[51] Int. Cl.[6] ..... E03D 1/06

[52] U.S. Cl. ..... 4/368; 4/365

[58] Field of Search ..... 4/368, 373, 365

[56] References Cited

U.S. PATENT DOCUMENTS

| | | | |
|---|---|---|---|
| 354,624 | 12/1886 | Boyle | 4/365 X |
| 529,584 | 11/1894 | Booth | 4/368 |
| 1,165,228 | 12/1915 | Coburn | 4/368 |

FOREIGN PATENT DOCUMENTS

| | | | |
|---|---|---|---|
| 0016153 | of 1892 | United Kingdom | 4/373 |
| 0009698 | of 1898 | United Kingdom | 4/373 |

*Primary Examiner*—Robert M. Fetsuga

*Attorney, Agent, or Firm*—Dallis Law Firm, P.A.

[57] ABSTRACT

A rotary siphon flushing device for use inside a water storage tank of a conventional commode or toilet. A siphon exhaust member is secured to the drainage port of the water storage tank. A rotary arm is axially attached to the siphon exhaust member. The rotary arm fills with water as the tank water level rises. A conventional pull chain lever rotates the rotary arm into the siphon exhaust member thereby inducing a siphon flushing action. The rotary arm rotates back to a filling position after the discharge.

11 Claims, 3 Drawing Sheets

ROTARY SIPHON FLUSHER

BACKGROUND OF THE INVENTION

1. FIELD OF THE INVENTION

The present invention relates to a flushing device of a standard commode and, more particularly, to a rotary flushing device for use inside the water storage tank of a standard commode.

2. DESCRIPTION OF THE RELATED ART

There are numerous known design problems associated with the standard rubber stopper flap used to discharge water from the water storage tank into the bowl of a commode. After a period of time, the rubber stopper begins to decay or deform and fail to properly seal the discharge port of the water storage tank. Many gallons of water are often wasted through the failure of the rubber stopper, not to mention the labor and expense required to replace it. In addition to these basic design flaws, the rubber stopper does not provide an effective means of controlling the quantity of water that is flushed through the commode system. As water conservation efforts have increased in importance, many alternative devices to the rubber stopper have been devised. Among the most popular alternatives are siphon flushing devices that use the principles of suction and hydraulic head to induce a siphoning flushing effect.

The existing prior art relating to siphon flushing devices includes a tank check valve siphon flushing device described by Osmond, U.S. Pat. No. 5,301,375. The Osmond device uses a inverted U-shaped siphoning tube as the means for discharging water from the storage tank to the bowl. The inverted U-shaped tube is charged by an overhead water bridge with a check valve that controls water discharge into the siphon tubing.

Frank, U.S. Pat. No. 5,274,855 describes a complicated siphon flushing mechanism consisting of two inverted U-shaped traps that induce a siphoning effect and discharge the storage tank water. An internal flexible connector tube activates the siphoning effect through a lifting action causing communication between the two inverted U-shaped trap units.

Other siphon flushing devices exist in the prior art that incorporate the conventional inverted U-shape configuration in the device. The majority of these devices, however, contain numerous valves and seals necessary to control the siphon flushing action. Such inventions include U.S. Pat. No. 5,140,712 by Kwod Wang-on, U.S. Pat. No. 4,965,892 by McDonough, and U.S. Pat. No. 4,649,953 by Dudley.

In each of the prior art references provided and those reviewed, none of the siphon flushing devices incorporate a rotary action for activating the siphon flushing effect. One of the many advantages of the rotary siphon flusher, as described herein, is that the rotation action of the rotary pipe member can be activated by the conventional chain pull mechanism common in most commodes. Additionally, there is no need for ancillary valves or seals. The device can be easily installed in the water storage tank of most conventional commodes or toilets. The quantity and force of water discharged by the present invention can be determined by the configuration or the rotary pipe member of the device.

SUMMARY OF THE INVENTION

It is therefore an objective of this invention to provide a durable and reliable flushing mechanism for the water storage tank of a conventional commode or toilet.

It is further an objective of this invention to provide a flushing mechanism that uses a unique rotary siphoning action to activate the discharge of water through a conventional commode or toilet.

It is still further an objective of this invention to control the rate and quantity of water that is discharged through a conventional commode or toilet.

It is yet further an objective of this invention to provide a siphon flushing device with a minimum number of valves and seals that may fail with time.

These as well as other objectives are accomplished with a siphon exhaust pipe member with a threaded end that inserts into the discharge port of a conventional toilet water storage tank. The threaded end of the siphon exhaust pipe member is secured to the water storage tank with a lock nut and rubber washer. A semi-circular tube or rotary pipe is pivotally attached to the siphon exhaust member. When the tank is full of water, the rotary pipe also fills with water. A siphoning effect is achieved through the rotation of the rotary pipe member into the siphon exhaust member. This rotation is initiated by the pull chain mechanism common to most conventional toilets and commodes. Once the siphoning action is complete and tank water contents discharged, the rotary pipe member returns to its original filling position.

BRIEF DESCRIPTION OF THE DRAWINGS

A preferred embodiment of the present invention is described herein with reference to the drawings wherein.

FIG, 2*b* of the drawings shows a side view of the device just after the chain pulling mechanism has engaged the rotary insertion member.

Figure 2A:
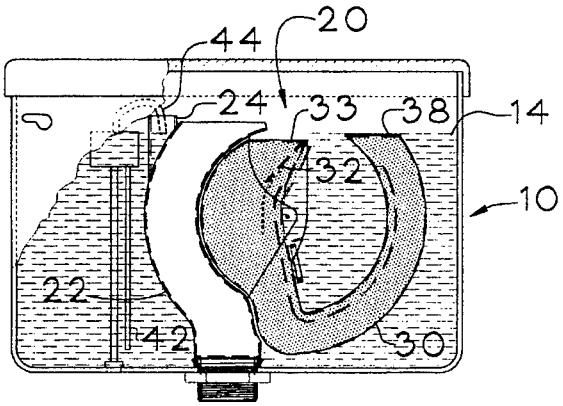
FIG. 2*a* of the drawings shows a side view of the device in a filled position prepared to initiate the siphon action.
Figure 2B:
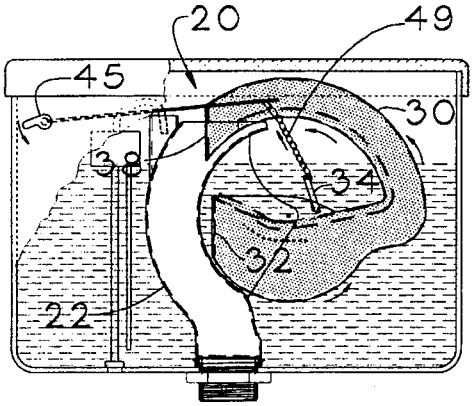
Figure 2C:
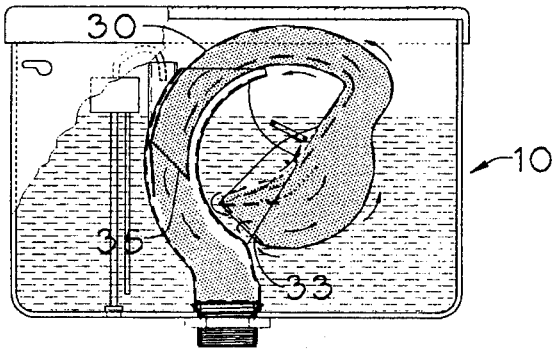

FIG. 2*c* of the drawings shows a side view of the device just as the siphon action begins.

Figure 2D:
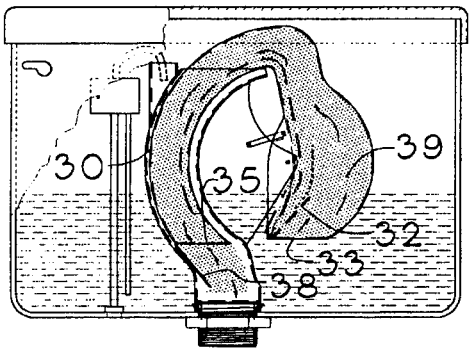
Figure 2E:
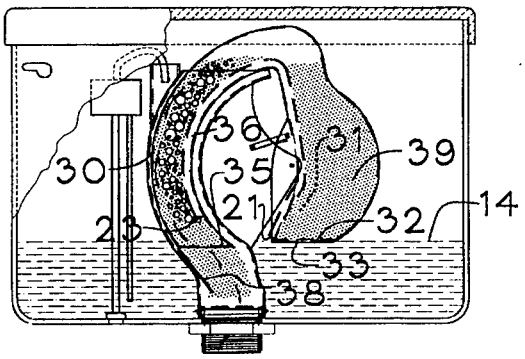

FIG. 2*d* of the drawings shows a side view of the device showing the siphon action in full operation FIG. 2*e* of the drawings shows the device nearing the completion of the siphoning phase and the release of air from the rotary air tube into the rotary pipe.

Figure 2F:
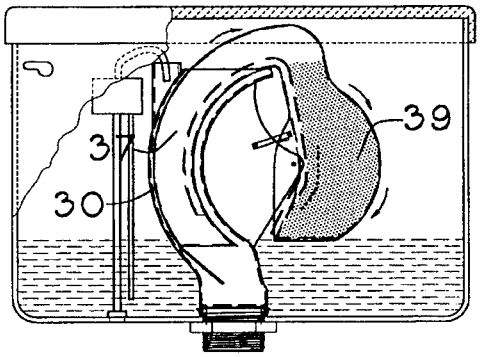

FIG. 2*f* of the drawings shows the ballast member filled with liquid and causing the rotary pipe to rotate back to its original position.

Figure 2G:
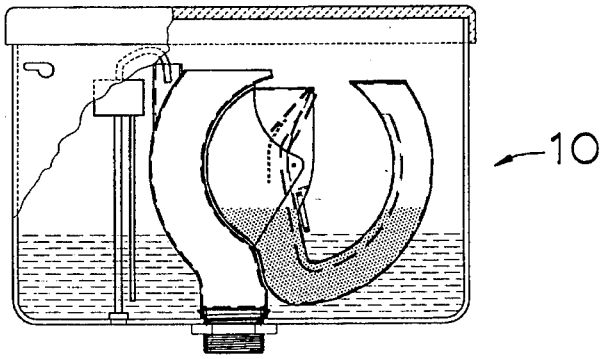

FIG. 2*g* of the drawings shows the device in the original fill position preparing for another flush cycle.

DETAILED DESCRIPTION OF THE PREFERRED EMBODIMENT

Figure 1:
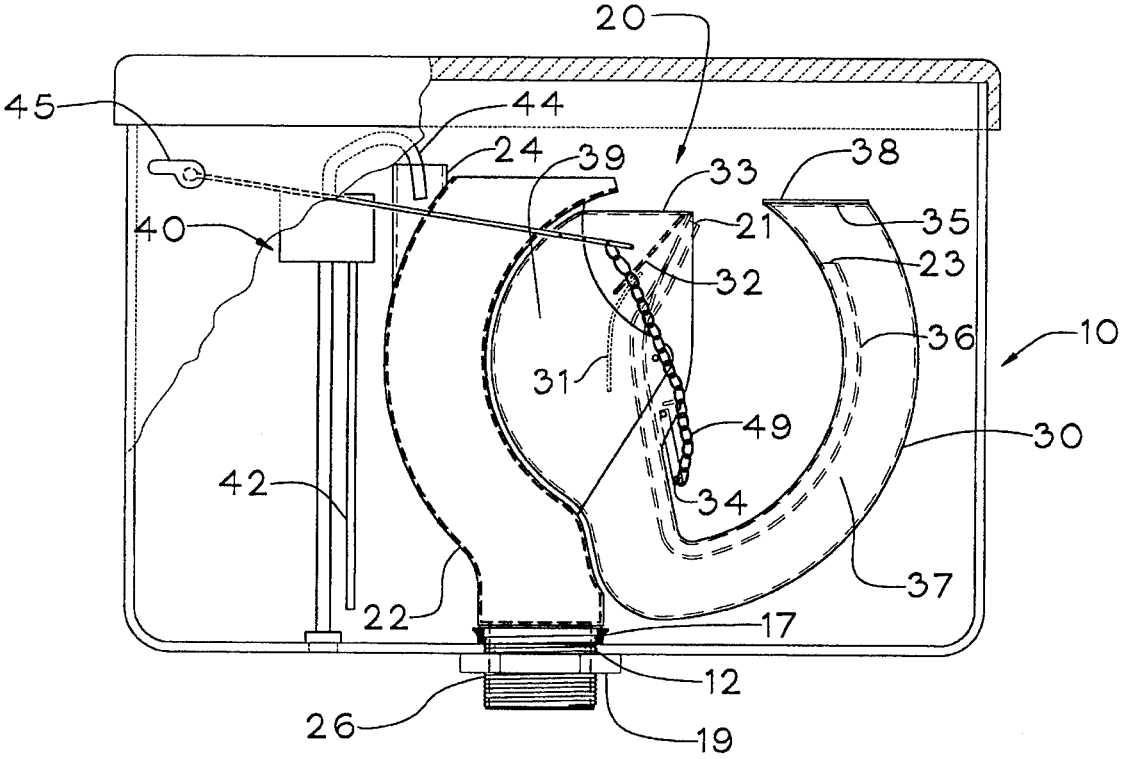
FIG. 1 of the drawings shows a side view of the rotary siphon flusher installed in the water storage tank of a conventional commode.

Referring to the drawings by numerals of reference, there is shown in FIG. 1 a water storage tank (10) of a standard bathroom commode. Inside the tank (10) is the rotary siphon flusher (20), a toilet tank valve (40) and flushing handle (45). The rotary siphon flusher (20) is secured into the drainage port (12) of a storage tank (10) by means of a nut (19) and flexible washer (17) screwed onto the threaded foot (26) of the rotary siphon flusher (20). The rotary siphon flusher (20) comprises a siphon exhaust pipe member (22) which is fixed and stationary and the rotary pipe (30), the majority of which is designed to rotate and insert inside the siphon exhaust pipe member (22). The rotary pipe (30) has a tube insert member (37) and a tube ballast member (39). As shown in both FIGS. 1 and 1*a*, the toilet tank valve (40) comprises a tank fill pipe (42), a bowl fill pipe (44) and an elongated float (46). The flushing handle (45) is connected to the chain lever (47) and in turn connected to the pull chain (49).

Referring to FIGS. 2*a*–2*g*, a step-by-step depiction of the operation of the rotary siphon flusher (20) is demonstrated. As shown in FIG. 2*a*, the storage tank (10) is filled with water by means of the tank fill pipe (42). The bowl portion of the commode is filled by the bowl fill pipe (44) which discharges directly into the bowl through exhaust flue (24) which connects to the exhaust pipe member (22).

Figure 1A:
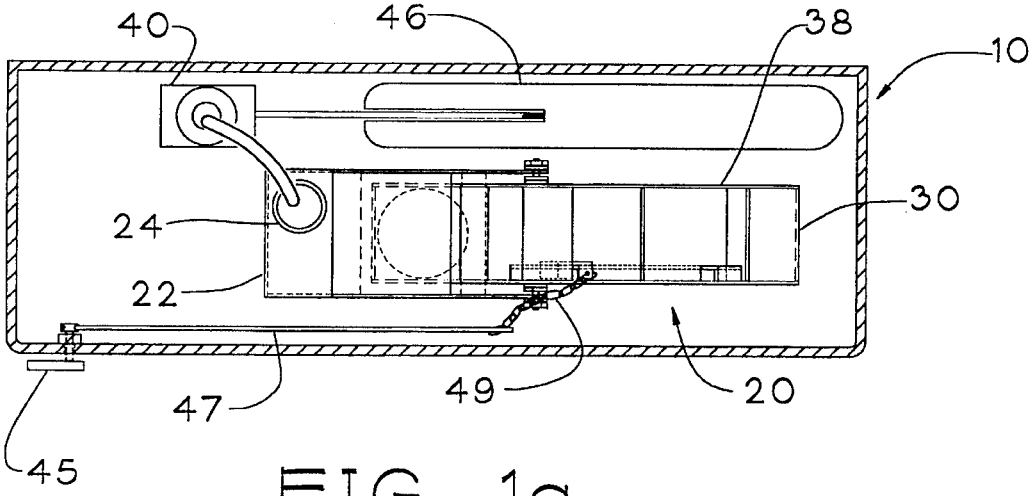
FIG. 1*a* of the drawings shows a top view of the rotary siphon flusher installed in the water storage tank of a conventional commode.

The liquid level in the tank shown in FIG. 2*a* is at least the same height as the discharge flap (38) of the rotary pipe (30). The fill flap (32) rests in an open position, allowing the tank water to fill the rotary pipe (30). The siphon exhaust pipe member (22) sits slightly higher than the rotary pipe (30) and therefore remains open to the free air space above the water line (14). The water level equilibrium is achieved by means of an elongated float (46) as depicted in FIG. 1*a*.

With the liquid level equilibrium achieved as shown in FIG. 2*a*, the flushing action is initiated in FIG. 2*b*. By activating the flushing handle (45), the rotary pipe (30) is put into motion by means of the rotary lever (34) connected to the pull chain (49). The design of the rotary siphon flusher (20) is such that the rotary pipe (30) is of a certain shape and size sufficient to rotate and insert into the interior tubing of the siphon exhaust member (22). The entire inner tubing of the rotary pipe (30) remains full of liquid during the initial rotation action. The discharge flap (38) remains closed until the gravitational force upon the liquid overcomes the relevant rotational forces that keep the discharge flap (38) closed. The fill flap (32) is also in a closed position during the initial rotation of the rotary pipe (30) as the centrifugal force of the liquid inside maintains the fill flap (32) in the closed position.

Referring to FIG. 2*c*, the rotary flushing motion of the rotary pipe (30) is almost complete. The siphoning effect begins as liquid discharging out of the discharge end (35) of the rotary pipe (30) and this suction effect begins to draw water in from the bottom of the storage tank (10) through the fill end (33) of the rotary pipe (30).

Referring to FIG. 2*d*, the rotary pipe (30) is shown in its full, inverted siphoning position. Both the discharge flap (38) and the fill flap (32) are in full open positions. The siphoning action continues until such time that air enters the rotary pipe (30).

Referring to FIG. 2*e*, the water siphoning effect is broken by the rotary air tube (36). This is accomplished when the water level (14) falls below the air intake orifice (21) of the rotary air tube (36). As air is drawn through the rotary air tube (36) and discharged into the tube insert member (37) from the air discharge orifice (23) of the rotary air tube (36) the siphoning water seal is broken. With the siphoning effect broken, the water flow in the tube ballast member (39) reverses causing the fill flap (32) to close. The closure of the fill flap (32) is aided by the ballast baffle (31) that directs a portion of the backflow behind the fill flap (32) causing it to close rapidly.

Referring to FIG. 2*f*, the tube insert member (37) of the rotary pipe (30) is vacated of liquid while the tube ballast member (39) section remains filled with liquid causing the entire rotary pipe (30) to rotate back into the original resting position as shown in FIG. 2*g*. The tank (10) is then re-filled in preparation for additional flushing action.

A preferred embodiment of the present invention is described herein. It is to be understood, of course, that changes and modifications may be made in the embodiment without departing from the true scope and spirit of the present invention as defined by the appended claims.

That which is claimed is:

1. A rotary siphon flushing device for discharging a liquid from a liquid tank through a tank drainage port into a connected bowl, said rotary siphon flushing device comprising, in combination:

a. a siphon exhaust pipe having an open-air end and a tank insertion end connected to said tank drainage port;

b. a rotary pipe axially and movably secured to an axis point centrally located to said rotary siphon flushing device, said rotary pipe further comprising a tube insert member and a tube ballast member, said tube ballast member being adjacent to said siphon exhaust pipe when said liquid tank is filled and having a fill end, said tube insert member having a discharge end; and c. a lever means for rotating said rotary pipe around said axis point such that said tube insert member inserts inside said open-air end of said siphon exhaust pipe when said liquid tank is full inducing a siphoning action by initiating a continuous flow of said liquid from said fill end of said tube ballast member through said discharge end of said tube insert member.

2. The device as claimed in claim 1 wherein said tank insertion end of said siphon exhaust pipe further comprises an exterior threaded portion secured to said tank drainage port with a flexible washer and a nut.

3. The device as claimed in claim 1 wherein said lever means for rotating said rotary pipe comprises:

a. an arm axially secured to said rotary pipe proximally located to said axis point;

b. a pull end of said arm secured to a pull chain; and c. a torque end of said arm operative to induce rotation of said rotary pipe when said pull end is engaged by said pull chain.

4. The device as claimed in claim 1 wherein said open-air end of said siphon exhaust pipe includes an exhaust flue, said exhaust flue including a bowl fill pipe extending therethrough, said connected bowl being filled with said liquid by means of said bowl fill pipe.

5. The device as claimed in claim 1, further comprising an elongated float connected to a toilet tank valve, said elongated float being positioned to rest between said rotary siphon flusher and an interior wall of said liquid tank.

6. The device as claimed in claim 1 wherein said tube insert member of said rotary pipe and siphon exhaust pipe are arcuately shaped.

7. The device as claimed in claims 1,2,3,4,5 or 6 wherein said fill end of said tube ballast member has an inner fill flap which prevents back flow of said liquid through said tube ballast member.

8. The device as claimed in claims 1,2,3,4,5 or 6 wherein said discharge end of said tube insert member has an outer discharge flap which opens by natural gravitational means when said discharge end of said tube insert rotates into said open-air end of said siphon exhaust pipe.

9. The device as claimed in claim 1 wherein a rotary air tube is attached to said rotary pipe, said rotary air tube having a first and second end with an air intake orifice at said first end and an air discharge orifice at said second end, said air discharge orifice opening to an internal portion of said pipe insert member of said rotary pipe, said air intake orifice opening to said liquid being located proximate to an exterior portion of said tube ballast member of said rotary pipe.

10. The device as claimed in claim 1 including a ballast baffle attached to an interior surface of said tube ballast member and spatially oriented parallel to said axis point, said ballast baffle having a first baffle end and a second baffle end, said first baffle end being located proximate to said fill end of said tube ballast member such that said fill flap rests against said ballast baffle when said liquid is siphoning through said rotary pipe, said second baffle end extending in an opposite direction to said first baffle end such that a cross-sectional inflow area defined by said second baffle end and said interior surface of said tube ballast member is less than a cross-sectional outflow area defined by said discharge end of said tube insert member.

11. A rotary siphon flushing device for discharging a liquid from a liquid tank through a tank drainage port into a connected bowl, said rotary siphon flushing device comprising in combination:

a. a siphon exhaust pipe having an open-air end and a tank insertion end connected to said tank drainage port, said open-air end of said siphon exhaust pipe includes an exhaust flue, said exhaust flue including a bowl fill pipe extending therethrough, said connected bowl being filled with said liquid by means of said bowl fill pipe;

b. a rotary pipe axially and movably secured to an axis point centrally located to said rotary siphon flushing device said rotary pipe further comprising a tube insert member and a tube ballast member, said tube ballast member being adjacent to said siphon exhaust pipe when said liquid tank is filled and having a fill end, said fill end of said tube ballast member having an inner fill flap which prevents back flow of said liquid through said tube ballast member, said tube insert member having a discharge end, said discharge end of said tube insert member having an outer discharge flap which opens by natural gravitational means when said discharge end of said tube insert rotates into said open-air end of said siphon exhaust pipe, said tube insert member and siphon exhaust pipe being arcuately shaped;

c. a lever means for rotating said rotary pipe around said axis point such that said tube insert member inserts inside said open-air end of said siphon exhaust pipe when said liquid tank is full inducing a siphoning action by initiating a continuous flow of said liquid from said fill end of said tube ballast member through said discharge end of said tube insert member, said lever means comprising:

i. an arm axially secured to said rotary pipe proximally located to said axis point;

ii. a pull end of said arm secured to a pull chain; and iii. a torque end of said arm operative to induce rotation of said rotary pipe when said pull end is engaged by said pull chain;

d. an exterior threaded portion of said tank insertion end of said siphon exhaust pipe designed to secure to said tank drainage port with a flexible washer and a nut;

g. an elongated float connected to a toilet tank valve, said elongated float being positioned to rest between said rotary siphon flusher and an interior wall of said liquid tank;

k. a rotary air tube attached to said rotary pipe, said rotary air tube having a first and second end with an air intake orifice at said first end and an air discharge orifice at said second end, said air discharge orifice opening to an internal portion of said pipe insert member of said rotary pipe, said air intake orifice opening to said liquid being located proximate to an exterior portion of said tube ballast member of said rotary pipe; and 1. a ballast baffle attached to an interior surface of said tube ballast member and spatially oriented parallel to said axis point, said ballast baffle having a first baffle end and a second baffle end, said first baffle end being located proximate to said fill end of said tube ballast member such that said fill flap rests against said ballast baffle when said liquid is siphoning through said rotary pipe, said second baffle end extending in an opposite direction to said first baffle end such that a cross-sectional inflow area defined by said second baffle end and said interior surface of said tube ballast member is less than a cross-sectional outflow area defined by said discharge end of said tube insert member.

* * * * *